US005323706A

United States Patent [19]

Sugawara

[11] Patent Number: 5,323,706

[45] Date of Patent: Jun. 28, 1994

[54] PRINTING PRESS DISCHARGE APPARATUS FOR MIMEOGRAPH PRINTING MACHINE

[75] Inventor: Mitsuhiro Sugawara, Miyagi, Japan

[73] Assignee: Ricoh Company, Ltd., Tokyo, Japan

[21] Appl. No.: 63,956

[22] Filed: May 20, 1993

[30] Foreign Application Priority Data

May 20, 1993 [JP] Japan ..... 4-127808

[51] Int. Cl.[5] ..... B41L 47/14

[52] U.S. Cl. ..... 101/483; 101/477; 271/185

[58] Field of Search ..... 101/477, 483, 415.1, 101/378, 382.1; 198/408; 271/185, 225

[56] References Cited

U.S. PATENT DOCUMENTS

| | | | |
|---|---|---|---|
| 4,339,293 | 7/1982 | Takahashi et al. . | |
| 4,846,057 | 7/1989 | Endo et al. | 101/477 |
| 4,874,077 | 10/1989 | Yaguchi et al. | 198/408 |
| 4,887,168 | 12/1989 | Endo et al. . | |
| 4,905,595 | 3/1990 | Jeschke | 101/477 |
| 4,966,073 | 10/1990 | Hasegawa et al. . | |
| 5,074,212 | 12/1991 | Kobler et al. | 101/415.1 |
| 5,181,466 | 1/1993 | Ono | 101/415.1 |
| 5,218,907 | 6/1993 | Konorl et al. | 101/415.1 |

FOREIGN PATENT DOCUMENTS 60-224573 11/1985 Japan ..... 101/477

*Primary Examiner*—Eugene H. Eickholt

*Attorney, Agent, or Firm*—Oblon, Spivak, McClelland, Maier & Neustadt

[57] ABSTRACT

Discharging of used printing presses is executed in a narrow space of a mimeograph printing machine body, both simply and cheaply. A pair of rollers convey a used printing press peeled off from a plate cylinder. A press receiving plate swings by 180° around an axis. It receives the printing press conveyed by the pair of rollers at a first position thereof and further conveys the same by its swinging activity toward a second position. A discharge box collects and allows piling of the used printing presses conveyed by the press receiving plate. It is disposed at the end of the conveying path and below the second position of the press receiving plate. The press receiving plate thereby performs both swinging activity around the axis to convey the used printing presses toward the discharge box and compresses the same to increase the number of the printing presses to be discharged therein.

12 Claims, 3 Drawing Sheets

PRINTING PRESS DISCHARGE APPARATUS FOR MIMEOGRAPH PRINTING MACHINE

BACKGROUND OF THE INVENTION

1. Field of the Invention

The present invention relates to a discharge apparatus for discharging printing presses from a plate cylinder disposed in a mimeograph printing machine after a predetermined number of printings are completed based on each of the printing press.

2. Description of the Related Art

A conventional discharge apparatus for discharging a printing press, for example that described in Japanese laid open utility model publication number 204765/1986, needs a rubber roller for peeling off a used printing press wrapped around a plate cylinder, a pair of conveying rollers for conveying the printing press peeled off by the rubber rollers toward a discharge box installed in a section of a mimeograph printing machine and a rubber belt apparatus disposed between the rubber roller and the pair of conveying rollers for conveying the printing presses, so that a large number of parts are needed in the apparatus for conveying the printing presses, and both the scale and the cost of the printing press conveying apparatus increases.

Another conventional discharge apparatus for discharging a printing press, for example that described in Japanese laid open patent publication number 278928/1991, needs a pair of compression spring members, each connected to a pressure plate at opposite edges thereof, for exerting a pressure by the pressure plate on the printing press collected in the discharge box and needs several mechanisms for reciprocating the pressure plate, either in cooperation with or against, the compressing springs.

In addition, the conventional compressing apparatus for a printing press also needs a sensor and an actuator beside the pressure plate for sensing a filling of the discharge box with the printing presses collected therein, so that many parts are needed for the discharge apparatus.

Further, the conventional pressure plate for compressing the printing presses collected in the discharge box returns to a start position soon after its execution of compressing the printing presses, whereby incomplete compressing of the printing presses occurs. Fewer of the printing presses can be collected in the discharge box because they are insufficiently compacted.

Another conventional discharge apparatus for discharging a printing press has a receiving plate which is pivotably mounted by a shaft fixed to a machine body and disposed in a printing press conveying path for receiving the printing presses peeled off from the plate cylinder It can swing by 90° around the shaft after receiving the printing press, to position in a direction perpendicular to that of the printing press receiving position. But it does not disclose the conveying in the same direction as that of the receiving of the printing press, and the compressing of the printing presses.

SUMMARY OF THE INVENTION

It is an object of the present invention to convey a printing press peeled off from a plate cylinder toward a discharge box with a short conveying path.

It is another object of the present invention to minimize a number of parts in a conveying apparatus for conveying the printing press and so to provide an economical machine.

It is yet a further object of the present invention to provide sufficient compressing of the printing presses in the discharged box that many compressed printing presses can be collected therein by use of a simple compressing mechanism.

According to the present invention, the above and other objects of the present invention are accomplished by providing a printing press discharge apparatus employed in a mimeograph printing machine having a rubber roller for peeling off a printing press wrapped around a plate cylinder therefrom and a discharge box for collecting the printing presses peeled off by the rubber roller from the plate cylinder and a pair of rollers for conveying the printing press peeled off by the rubber roller. A swingable plate is disposed between the pair of the rollers and the discharge box, which receives the printing presses conveyed by the pair of rollers at level position thereof and conveys the same by pivotally swinging by 180° from the level position to a discharge position above the discharge box to discharge the printing presses thereinto via gravity.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENT

Hereinbelow will be described a printing press discharge apparatus employed in a mimeograph printing machine of the present invention with reference to the drawings.

Figure 1:
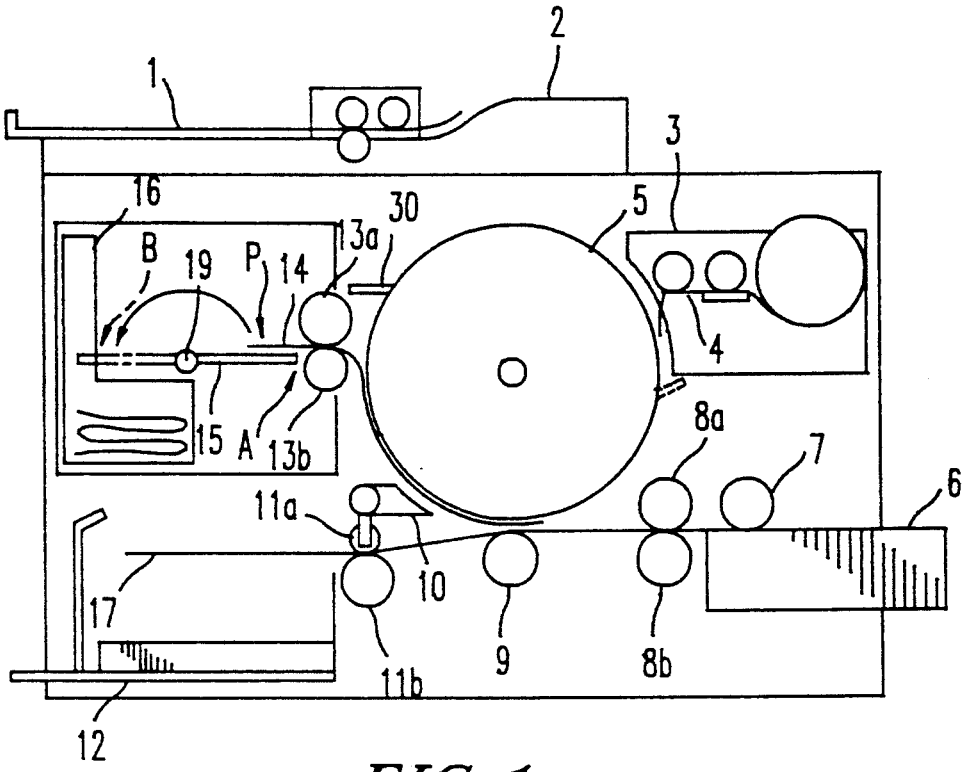
FIG. 1 is a schematic elevational view of a mimeograph printing machine employing the printing press discharge apparatus of the present invention.

In FIG. 1, a manuscript document 1 is scanned by a scanner 2 so that a photo-electrical signal may be generated according to images of the manuscript document by a device not shown in the figures. See, for example, the apparatus shown in U.S. Pat. No. 4,887,168.

A plotter plots images on the printing press mounted on plate cylinder 5, based upon the photo-electrical signals, to thereby make a master of a printing press.

Before applying the new master printing press onto the plate cylinder 5, the used printing press already on the periphery of the plate cylinder 5 must be peeled off therefrom to be discharged into a discharge box 16 so that the new master printing press 4 may be wrapped around the plate cylinder 5 with a leading edge thereof clamped by a clamper 30. After that, blank paper sheets 6 stored in a cassette apparatus 6A are fed successively by a first feeding roller 7 and further transferred by a pair of second feeding rollers **8*a* and 8*b* toward a printing position in which the blank paper is pressed by a pressing roller 9 from the back side thereof against a periphery of the plate cylinder 5 which is wrapped by the printing press, so that conventional mimeograph printing is completed. The printed sheets 17 are conveyed by feed rollers 11***a* and 11*b* to a discharge cassette 12.

The used printing press discharge will now be described in detail. As illustrated in FIG. 1, the printing press discharging apparatus includes a pair of discharging rollers 13*a* and 13*b* for conveying the used printing presses 14 peeled off from the plate cylinder 5, a discharging box 16 for collecting a plurality of the used printing presses 14 conveyed by the pair of discharging rollers 13*a* and 13*b*, and a receiving plate 15 for receiving the printing press 14 and, by swinging about its pivot axis, delivering the printing press from the pair of discharging rollers 13*a* and 13*b* to the discharging box 16.

Figure 4:
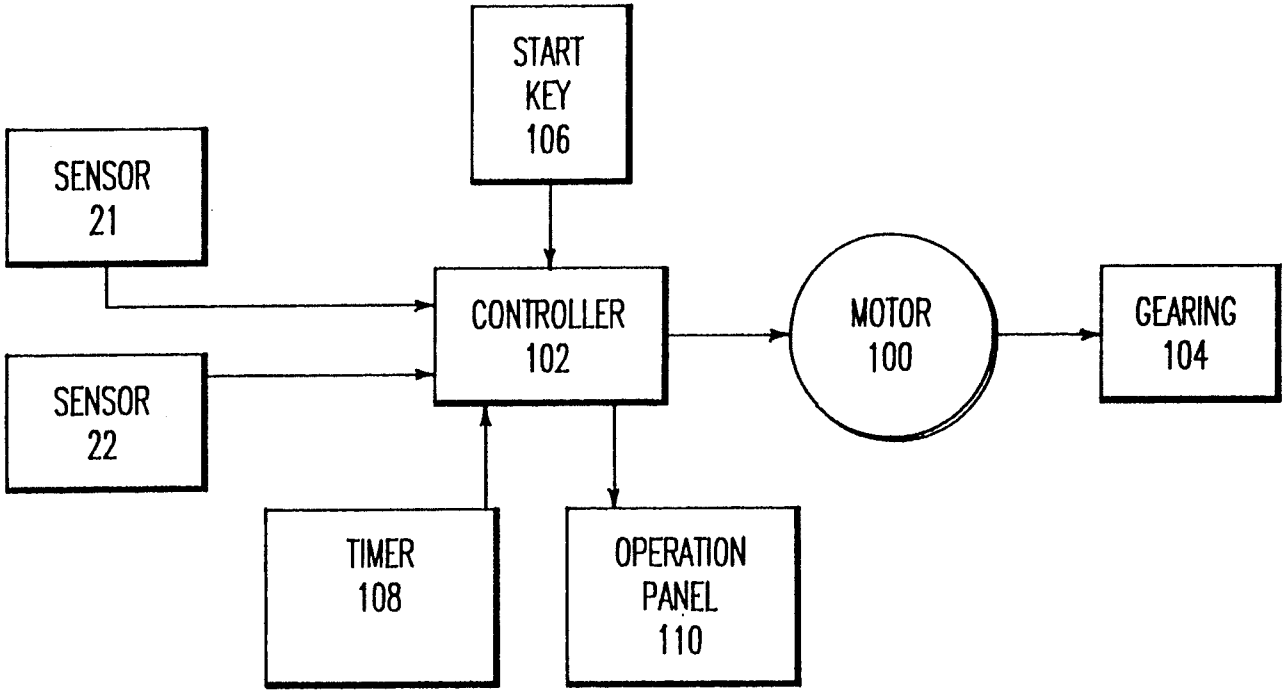
FIG. 4 schematically shows the control system.

The pair of discharging rollers 13*a* and 13*b* are made of an elastic material, for example rubber, and are driven by a conventional motor 100 controlled by an electronic controller 102 (FIG. 4).

The press receiving plate 15 is pivotally mounted around a shaft 19 supported in parallel to the axis of the pair of the discharging rollers 13*a* and 13*b*, to swing around the shaft such that an edge of the receiving plate 15 can be positioned at either a receiving position A near the pair of the rollers 13*a* and 13*b* or at a discharging position B above the discharging box 16, by swinging 180° from the receiving position A.

The press receiving plate 15 is planar and is alternatively swung in the clockwise and counterclockwise directions by a mechanism described hereinafter.

The press receiving plate 15 includes an integral projection 22 (FIG. 2) as an actuator at one side edge portion thereof for actuating sensors 20 and 21 disposed at predetermined portions of the machine body, so that the sensors 20 and 21 generate output signals.

Instead of the above construction for the press receiving plate 15, either a meshed plate or a grid shaped plate can be used if these plates have the appropriate shape, rigidity and strength to convey the used printing press 14.

Figure 2:
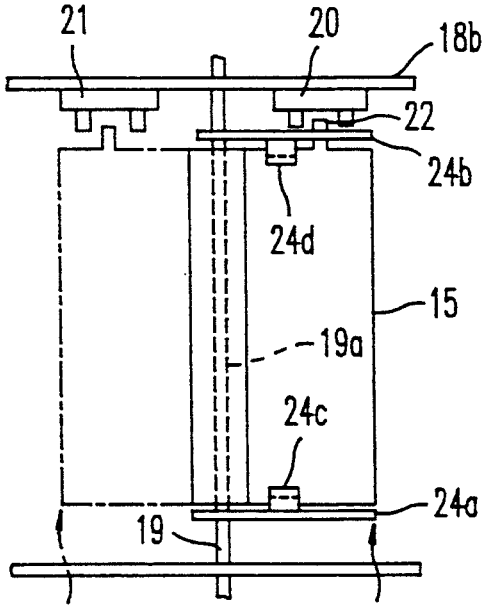
FIG. 2 is a partially enlarged plan view of the swingable plate in the mimeograph printing machine.

In FIG. 2, parts 18*a* and 18*b* are side plates of the mimeograph printing machine in which the present invention is employed. Each of the ends of the shaft 19 mounting the receiving plate 15 is pivotally supported by one of the side plates 18*a* and 18*b*.

At another portion of the side plate 18*b*, near which a discharging of the used printing presses 14 into the discharging box 16 is executed, is fixed the sensor 21 for sensing the filling of the discharge box 16 with the discharged printing presses 14.

Stated in more detail, the sensor 21 has a gap which the projecting portion 22 of the receiving plate 15 as an actuator can pass through, and generates an output signal to the controller 102 indicative of the filling of the discharge box 16 with the printing presses 14, unless the actuator cannot pass through the gap thereof due to its movement being blocked by the compressed, collected and piled printing presses 14 in the discharge box 16.

As to the control of the swinging of the press receiving plate 15, the motor 100 is controlled to alternately rotate in opposite directions by the controller 102 so that the press receiving plate 15 swings from the discharge position A to the discharge position B, and returns to its home position, namely the discharge position A, if the projection 22 as an actuator enters into the gap of the sensor 21 within a predetermined time after a commencement of the swinging of the press receiving plate 15 toward the discharge position B.

In addition, at a position of the side plate 18*b* near to the press receiving position A, another sensor 20 is disposed for sensing the projection 22 projecting from the press receiving plate 15 as an actuator, and generates an output signal to the controller 102 indicative of the presence of the actuator in the gap thereof for stopping the backward swinging of the press receiving plate 15. The swinging of the press receiving plate 15 is hereinafter described in greater detail.

Before commencement of peeling off of the used printing press 14 from the plate cylinder 5, the press receiving plate 15 is positioned at the press receiving position A illustrated in FIGS. 1 and 2 by a solid line, with the actuator being sensed in the gap of the sensor 20.

Figure 3:
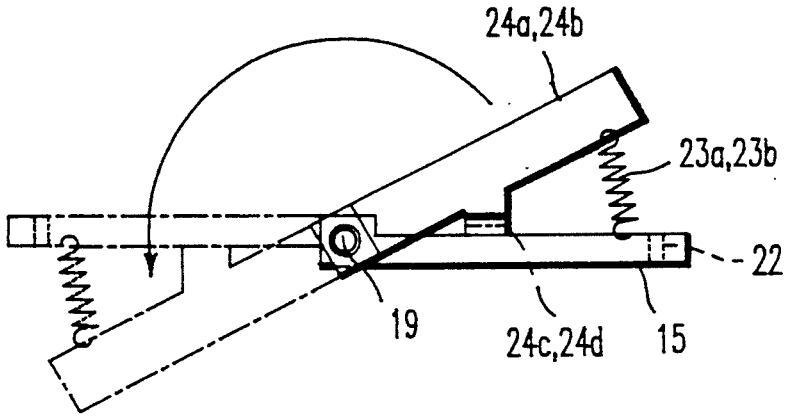
FIG. 3 is an end view of the swingable plate.

As illustrated in the FIGS. 2 and 3, a pair of swinging bars in the form of levers 24*a* and 24*b* are each fixed, for example by a screw not shown in the figures, to the shaft 19 and disposed near each of the side edges of the press receiving plate 15.

The press receiving plate 15 has a bore 19*a* extending therethrough in the direction perpendicular to press conveying so that the shaft 19 can freely penetrate the press receiving plate 15 and allow pivotal swinging thereof around the shaft 19.

Further, the press receiving plate 15 is related to the levers 24*a* and 24*b* in the manner described below:

Each of the side edges of the press receiving plate 15 is connected to one of the levers 24*a* and 24*b*, respectively, by means of compression springs 23*a* and 23*b* so that the press receiving plate 15 follows the levers 24*a* and 24*b*. Moreover, it is the levers 24*a* and 24*b* which are directly driven by the motor 100 to swing in both forward and backward directions.

Stated in more detail, for swinging the press receiving plate 15, a gear of gearing 104 is fixed to one end portion of the axle 19, and is meshed with another gear of the gearing 104 driven by the motor 100.

Accordingly, when the motor 100 starts to rotate in the forward or backward directions, the rotation of the motor drives the levers 24*a* and 24*b* to make the press receiving plate 15 swing via springs 23*a* and 23*b*.

These levers 24*a* and 24*b* are designed to rotate both in the forward and backward directions with the shaft 19 by 180°. The swinging range of the press receiving plate 15 is not the same as that of the levers 24*a* and 24*b*, however, because of expansion of the springs 23*a* and 23*b*, which are expanded according to quantity of the discharged and compressed printing presses 14 and the discharge box 16.

In addition to the above, a pair of stoppers 24*c*, 24*d* are integrally formed on a middle portion of each of the levers 24*c* and 24*d* to maintain a distance between the press receiving plate 15 and the levers 24*a* and 24*b*.

Operation of the press discharging device of the present invention will now be further described:

When a start key 106 is activated by an operator, the press discharging operation is commenced.

Firstly, the plate cylinder 5 stops rotating. Then, the clamper 30 is opened by a conventional mechanism (not shown in the figures) and is kept open by a certain angle so that an edge of the used press 14 wrapped around the plate cylinder 5 is released from the plate cylinder 5.

Secondly, the used printing press 14 is peeled off by a peeling apparatus such as that shown in U.S. Pat. No. 4,846,057 and led to the pair of the rollers 13*a* and 13*b*, and is further conveyed thereby to the press receiving plate positioned at the press receiving position A.

Thirdly, the printing press 14 on the press receiving plate 15 positioned at the press receiving position A is conveyed by swinging movement thereof to a position B above the discharge box 16, and either dropped thereinto if a small number of the printing presses 14 have been collected therein, or compressed by the swinging motion of the press receiving plate 15 if the discharge box is nearly full.

When the pair of levers 24*a* and 24*b* commence the movement from the press receiving position A, the press receiving plate 15 follows due to the connection by the pair of compression springs 23*a* and 23*b* and, after that, the projection 22 arrives at the gap of the sensor 21.

At that time, an output signal is generated by the sensor 21 to the controller for controlling the motor to stop the swinging of the receiving plate 15.

Therefore, a plurality of the printing presses 14 collected in the nearly full discharge box 16 are compressed by the press receiving plate 15. Because the compressing power of the pair of the compressing springs 23*a* and 23*b* increases as they are expanded with increased filling of the discharge box 16, the size of the mass of printing presses 14 collected in the discharge box 16 can be minimized.

Shortly after that, the motor 100 is controlled by the controller 102 to operate in the backward direction, so that both the pair of levers 24*a* and 24*b* and the press receiving plate 15 return to the press receiving position A.

When the actuator 22 of the press receiving plate 15 arrives at sensor 20, the motor is controlled by the controller 102 to stop operating, thereby stopping both the pair of levers 24*a* and 24*b* and the press receiving plate 15.

The control of movement of the pair of levers 24*a* and 24*b* and the press receiving plate 15 in the case where the complete filling of the discharge box 16 is sensed by the sensor 21 is described hereinbelow.

The discharging of the printing presses 14 is repeatedly executed until the discharge box 16 is filled therewith. When the discharge box 16 becomes close to full, the used printing presses 14, which are piled in the discharge box 16, prevent the press receiving plate 15 from fully swinging, so that the pair of springs 23*a* and 23*b* connected between the side edges of the press receiving plate 15 and the levers 24*a* and 24*b* starts to expand at position B.

If the discharge box 16 has been filled with the used printing presses 14, the counter of a timer apparatus 108 counts up a predetermined number of counts before the actuator of the press receiving plate 15 arrives at the sensor 21, due to the printing presses 14 piled in the full discharge box. The counter provides sufficient time to assure complete compaction of the printing presses. The controller then controls the press receiving plate 15 to stop swinging in the direction indicated by the arrow illustrated in the FIG. 3 and to return to the press receiving position A.

At the same time, the controller 102 controls an operation panel 110 to display a mark representative of the filling of the discharge box 16 with the used printing presses 14 from the discharge box 16.

The present invention, described hereinabove is not limited to the automated printing press discharge apparatus as mentioned above but also covers a manually operated press receiving plate.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by letters patent of the United States is:

1. A discharge apparatus for a mimeograph printing machine having a machine body and a plate cylinder and comprising:

peeling off means for peeling off a used printing press wrapped around the plate cylinder;

a conveyor for conveying the used printing presses peeled off by the peeling means;

a collecting unit for collecting piles of the used printing presses peeled from the plate cylinder;

swinging means disposed between the conveyor and the collecting unit for receiving the used printing presses from the conveying means and for swinging to discharge the used printing presses into the collecting unit.

2. A discharge apparatus as recited in claim 1 wherein the swinging means has means for further compressing the used printing presses discharged thereby into the collecting unit when said collecting unit is nearly filled with the used printing presses.

3. A discharge apparatus as recited in claims 1 or 2 wherein the swinging means includes at least one swinging bar pivotally mounted about a fixed axis on the machine body and a press receiving plate for receiving printing presses conveyed from the conveyor, wherein said means for further compressing comprises at least one elastic member elastically rotatably connecting said at least one swinging bar and said press receiving plate.

4. A discharge apparatus as recited in claim 3 wherein said at least one elastic member comprises at least one compression spring.

5. A discharge apparatus as recited in claim 3 wherein one edge of said press receiving plate is pivotally connected to a shaft extending along said fixed axis, and wherein the at least one swinging bar is integrally connected to said shaft and so is pivotally supported by the machine body, whereby the press receiving plate swings both clockwise and counterclockwise by following movement of the swinging bar.

6. A discharge apparatus as recited in claim 1 or 2 including a first sensor for sensing the presence of an actuator of the press receiving plate at a press receiving position, means for swinging the press receiving plate toward the collecting unit, and a second sensor for sensing the actuator of the press receiving plate at a position for discharging the used printing presses into the collecting unit.

7. A discharge apparatus as recited in claim 6 including a controller having a detector for detecting a filling of the collecting unit with used printing presses, said detector being responsive to the second sensor failing to sense the actuator of the press receiving plate within a predetermined time period after commencement of swinging movement thereof from the press receiving position.

8. A discharge apparatus as recited in claim 6 wherein said controller has means responsive to a signal from the detector for displaying a mark indicative of the filling of the collecting unit with the used printing presses.

9. A method of discharging used printing presses to a collecting apparatus in a mimeograph printing machine having a plate cylinder, comprising the steps of:

(a) peeling off a used printing press from the plate cylinder;

(b) conveying the peeled off printing press to a swinging press receiving plate at a press receiving position;

(c) swinging the press receiving plate with the used printing press thereon toward a discharge position spaced 180° from the press receiving position; and (d) gravity discharging the used printing press into a collecting unit when the press receiving plate reaches the discharge position.

10. A method of discharging used printing presses to a collecting apparatus in a mimeograph printing machine having a plate cylinder, comprising the steps of:

(a) peeling off a used printing press from the plate cylinder;

(b) conveying the peeled off printing press to a swinging press receiving plate at a press receiving position;

(c) swinging the press receiving plate with the used printing press thereon toward a discharge position spaced 180° from the press receiving position;

(d) discharging the used printing press into a collecting unit when the press receiving plate reaches the discharge position; and (e) compressing a plurality of used printing presses collected and piled in the collecting unit by the swinging of the press receiving plate.

11. A method as claimed in claim 9, further comprising the steps of:

(a) sensing the presence of the press receiving plate at the press receiving position; and (b) sensing the presence of the press receiving plate at the discharge position.

12. A method as recited in claim 11 including the steps of stopping the swinging movement of the press receiving plate toward the discharge position and returning the press receiving plate to the press receiving position when the presence of the press receiving plate of the discharge position is not sensed at the discharge position within a predetermined time period after beginning said swinging step.

* * * * *

UNITED STATES PATENT AND TRADEMARK OFFICE

CERTIFICATE OF CORRECTION

PATENT NO. : 5,323,706

DATED : June 28, 1994

INVENTOR(S) : Mitsuhiro SUGAWARA

It is certified that error appears in the above-indentified patent and that said Letters Patent is hereby corrected as shown below:

On the title page, Item [30], the Foreign Application Priority Date should read as follows:

--May 20, 1992--

Signed and Sealed this

Sixth Day of September, 1994

*Attest:*

*Attesting Officer*

BRUCE LEHMAN

*Commissioner of Patents and Trademarks*